US006986317B2

(12) United States Patent
Biehl, Sr.

(10) Patent No.: US 6,986,317 B2
(45) Date of Patent: Jan. 17, 2006

(54) BOBBIN CASE TOOL AND METHOD OF USE

(76) Inventor: Howard G. Biehl, Sr., 11426 S. US 231, City of Dale, Dubois County, IN (US) 47523

( * ) Notice: Subject to any disclaimer, the term of this patent is extended or adjusted under 35 U.S.C. 154(b) by 0 days.

(21) Appl. No.: 11/063,786

(22) Filed: Feb. 23, 2005

(65) Prior Publication Data

US 2005/0183645 A1 Aug. 25, 2005

Related U.S. Application Data

(60) Provisional application No. 60/546,652, filed on Feb. 23, 2004.

(51) Int. Cl.
*D05B 59/04* (2006.01)

(52) U.S. Cl. ..... 112/475.01; 112/188

(58) Field of Classification Search ..... 112/475.01, 112/1, 186, 188, 270, 180; 81/3.07, 3.27, 81/3.4, 3.55; 72/458–460
See application file for complete search history.

(56) References Cited

U.S. PATENT DOCUMENTS 1,414,026 A * 4/1922 Laliberte ..... 112/188
3,376,838 A * 4/1968 Schiffmacher et al. ..... 112/186
3,460,411 A * 8/1969 Dyer ..... 81/3.07
3,882,805 A * 5/1975 Bianchi ..... 112/180
3,908,438 A * 9/1975 Norden ..... 72/458
4,362,071 A * 12/1982 Coker ..... 81/3.55
5,603,273 A * 2/1997 Nakamura et al. ..... 112/186

* cited by examiner

*Primary Examiner*—Ismael Izaguirre
(74) *Attorney, Agent, or Firm*—Gary K. Price, Esq.

(57) ABSTRACT

A bobbin case tool to aid in the removal and installation of a prior art bobbin case on a sewing machine. The bobbin case tool includes an elongated arm having a clearance, a pair of lead in chamfers, a locking tooth disposed between the pair of lead in chamfers, and a locking tooth face. In application, the bobbin case tool designed to engage a releasing lever of the bobbin case and operatively pivot the releasing lever to an unlock position. The bobbin case tool is positioned so that the locking tooth is engaged in a spindle clearance of the releasing lever. The releasing lever of the bobbin case is rotated by the bobbin case tool until the releasing lever forces a locking plate of the bobbin case out of a spindle locking groove of a sewing machine's bobbin holder.

7 Claims, 3 Drawing Sheets

FIG. 5
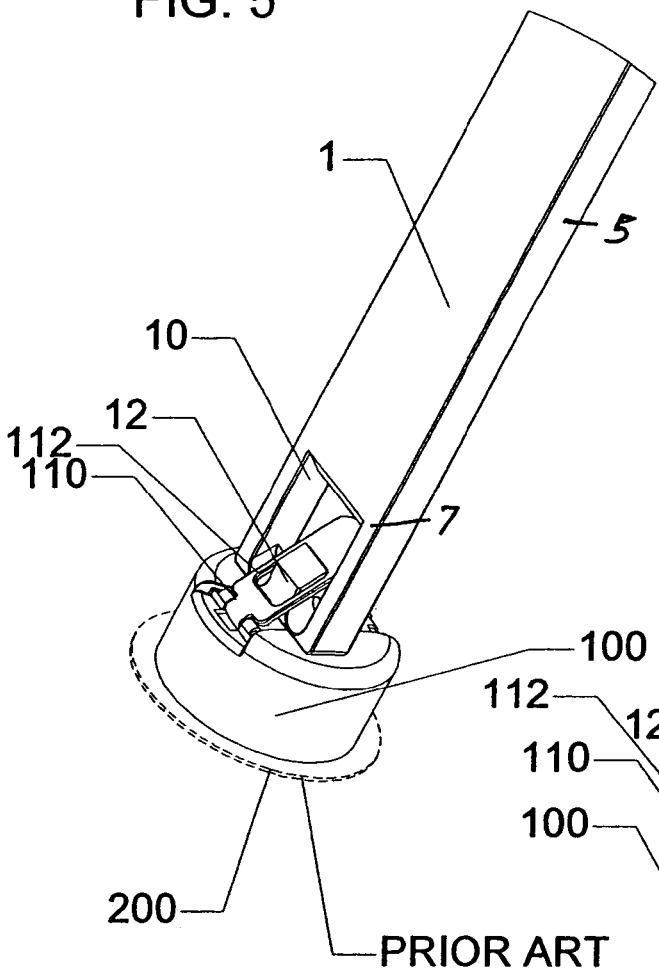
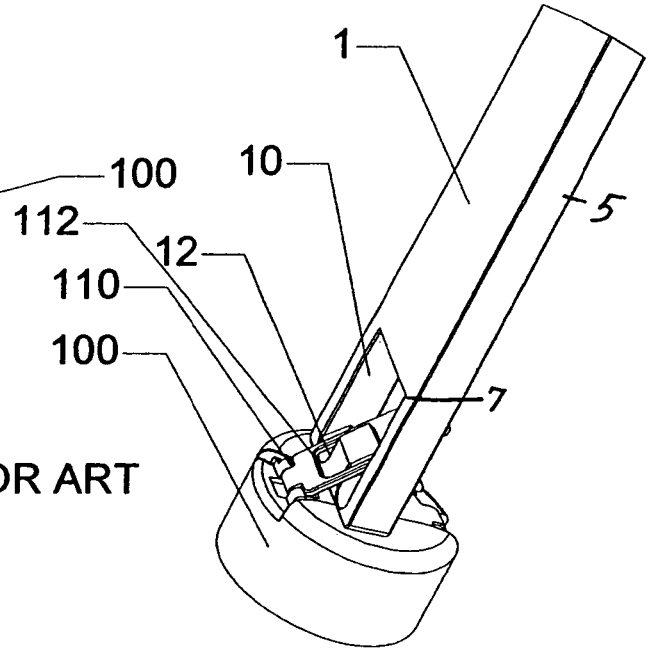
FIG. 6

BOBBIN CASE TOOL AND METHOD OF USE

CROSS REFERENCES TO RELATED APPLICATIONS

U.S. Provisional Application for Patent No. 60/546,652, filed Feb. 23, 2004, with title "Bobbin Case Tool and Method of Use" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a tool for facilitating removal and installation of a sewing machine bobbin case.

2. Brief Description of Prior Art

Sewing machines which sew and form a seam with upper and lower thread, particularly industrial sewing machines that consume a large amount of lower thread, require frequent replacements of a lower-thread bobbin. Usually, the bobbin replacement has been conducted manually: an operator stops the sewing machine, manually removes the bobbin case from the shuttle, disengages the bobbin from the bobbin case, replaces it with another wound lower-thread bobbin, and packs the other bobbin into the bobbin case.

Removal and reinstallation of a bobbin case and bobbin is a necessary, but often tedious, manual procedure for many sewing machines. A manual operation to change a bobbin, particularly in the middle of a sewing job, requires that a machine operator stop the operation, and remove the bobbin case with the empty thread spool. Thereafter, the machine operator must install a bobbin case with a full thread spool. Such a bobbin case changing operation is labor intensive, time consuming, inefficient, and extends the time required for part production in the workplace and thus, add significant cost to the production of the workpiece.

Therefore, there is a need to provide apparatus and methods for changing a bobbin case on a sewing machine, thereby substantially improving its efficiency.

As will be seen from the subsequent description, the preferred embodiments of the present invention are an aid in the removal and subsequent reinstallation of a sewing machine bobbin case.

SUMMARY OF THE INVENTION

The present invention is a bobbin case tool to assist in the manual removal and installation of a bobbin case on a sewing machine. In particular, the bobbin case tool is directed to an apparatus for removal and reinstallation of a prior art bobbin case of a sewing machine. The bobbin case tool includes an elongated arm having a grip means. The grip means includes a clearance, a pair of lead in chamfers, a locking tooth, and a locking tooth face. In application, the grip means of the bobbin case tool engages a releasing lever of the bobbin case and operatively pivots the releasing lever to an unlock position, thereby easing loading and unloading of the bobbin case and increasing the operational efficiency while the bobbin case is loaded and ejected.

BRIEF DESCRIPTION OF THE DRAWINGS

FIGS. 3, 4, 5 and 6 illustrate application of the bobbin tool with the prior art bobbin case.

DESCRIPTION OF THE PREFERRED EMBODIMENT

In accordance with the present invention, a bobbin case tool and method of use is disclosed. The bobbin tool is directed to an apparatus to assist in the manual removal and installation of a bobbin case and bobbin on a sewing machine. In the preferred embodiment, the apparatus of the present invention reduces obstacles relating to an operator's hand in disengaging the bobbin case in order to replace the bobbin on a sewing machine. In the broadest context, the bobbin case tool of the present invention consists of components configured and correlated with respect to each other so as to attain the desired objective.

FIGS. 1–6 illustrate a preferred embodiment of a bobbin case tool 1 made in accordance with the present invention. In the preferred embodiment, the bobbin case tool 1 is directed to an apparatus for removal and reinstallation of a prior art bobbin case 100 of a sewing machine (not shown).

Figure 1:
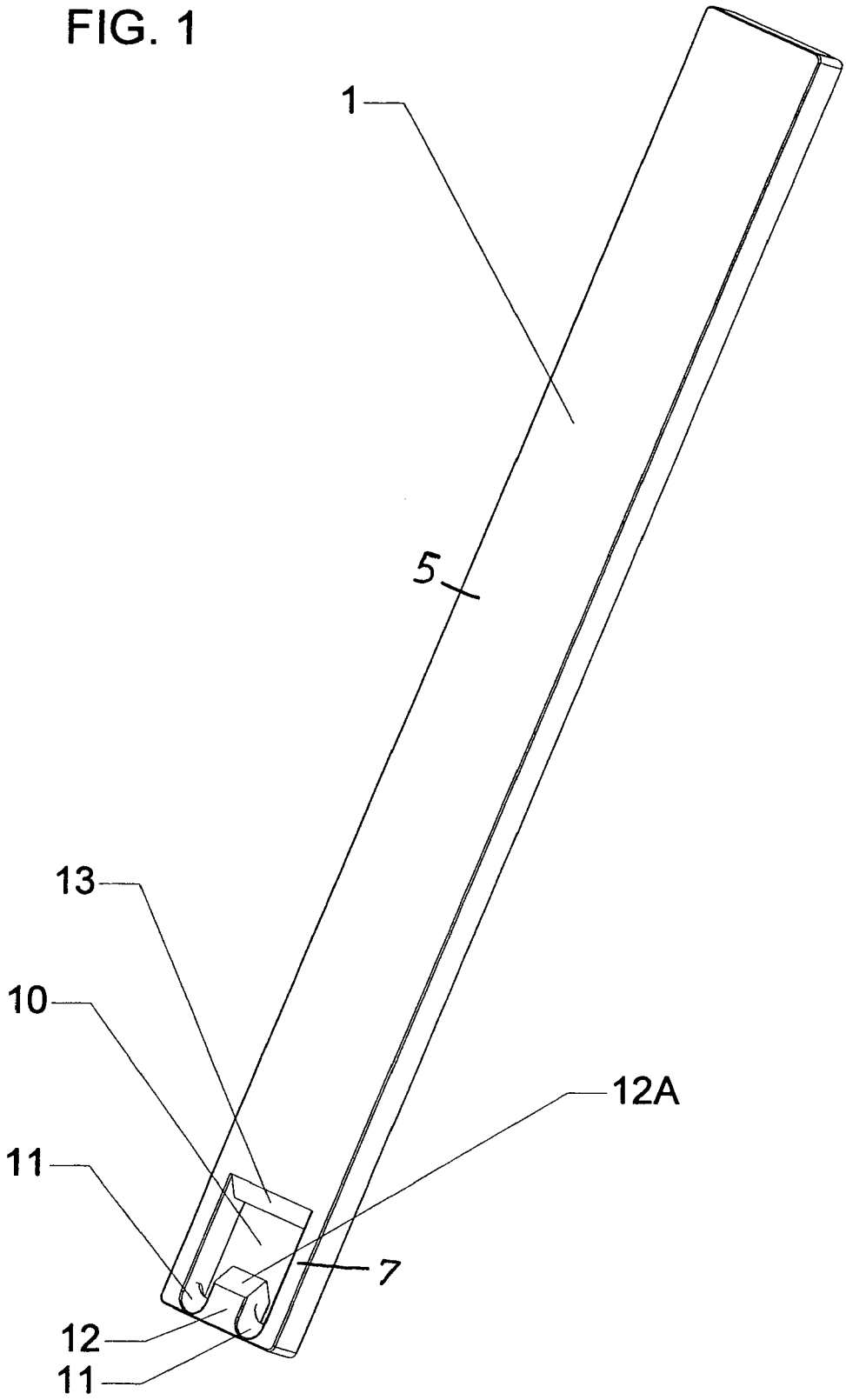
FIG. 1 is a perspective view of the preferred embodiment of the present invention, a bobbin case tool.

As best shown in FIG. 1, the bobbin case tool 1 includes an elongated arm 5, providing a grip means 7 disposed at a distal end of the arm 5. The grip means 7 preferably includes a clearance 10, a pair of lead in chamfers 11, a locking tooth 12 sandwiched between the pair of lead in chamfers 11, and a locking tooth face 12A disposed at a distal end of the locking tooth 12.

Figure 2:
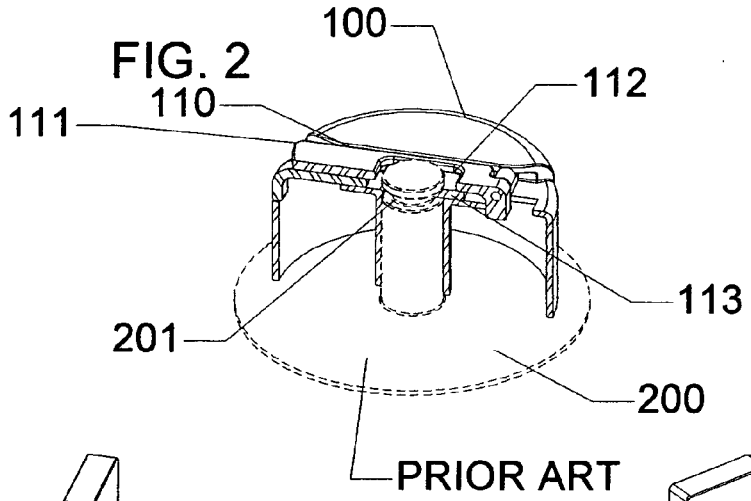
FIG. 2 is a perspective view of a prior art bobbin spindle with a cut-a-way illustration of a bobbin case.
Figure 3:
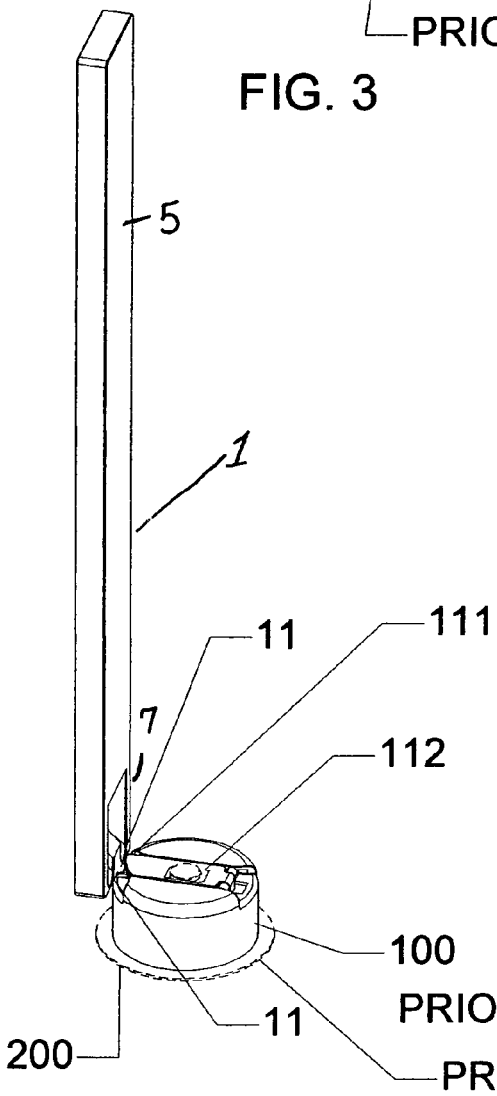

Referring to FIG. 2, the prior art bobbin case 100 is shown with a bobbin holder 200 which includes a spindle locking groove 201. The bobbin case 100 and the bobbin holder 200 are prior art. As illustrated, the bobbin case 100 is operatively mounted to the bobbin holder 200 in a known manner.

The bobbin case 100 includes a releasing lever 110 and a locking plate 113. The releasing lever 110 includes a forward edge 111 and a spindle clearance 112. The releasing lever 110 is pivotally mounted to the bobbin case 100, and an upward or sometimes outward pivoting motion of the lever 110 (some bobbin cases are removed horizontally and some vertically, most are horizontally removed and re-inserted) causes the locking plate 113 to translate to an unlocked position so that the bobbin case 100 can be removed from the bobbin holder 200.

In prior art application, in order to remove the bobbin case 100, the operator must manually grasp the forward edge 111 of the releasing lever 110 and move the releasing lever 110 to an unlock position, thereby permitting the bobbin case 100 to be removed from the bobbin holder 200. The embodiment of the present invention reduces obstacles to an operator's hand in properly grasping the releasing lever 110 and positioning the releasing lever 110 to an unlock position. As will be further described, the grip means 7 of the bobbin case tool 1 of the present invention engages the releasing lever 110 and operatively pivots the releasing lever 110 to the unlock position, thereby easing loading and unloading of the bobbin case 100 and increasing the operational efficiency while the bobbin case 100 is loaded and ejected.

Figure 4:
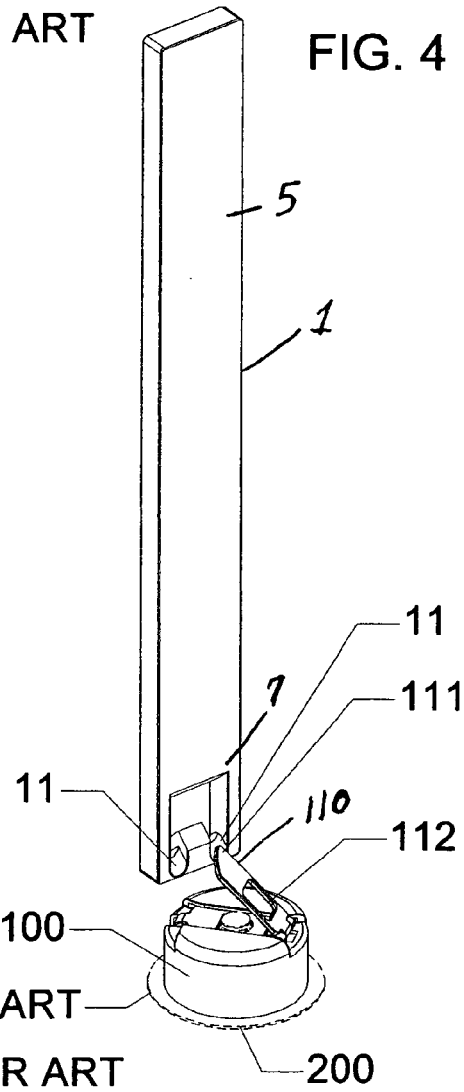

Referring now to FIGS. 3–6, in application, the forward edge 111 of the releasing lever 110 is engaged with one of the lead in chamfers 11. Once engaged, the operator then translates the tool 1 so that the releasing lever 110 pivots upward or outward to the unlock position as best shown in FIG. 4. As the forward edge 111 is lifted, the releasing lever 110 of the bobbin case 100 is lifted until the lever 110 moves the locking plate 113 out of the spindle locking groove 201. In particular, lifting the releasing lever 110 as described, applies a force against the locking plate 113, thereby moving the locking plate 113 out of the groove 201. Thus, pivoting the releasing lever 110 from a first, lock position upward to a second unlock position, thereby unlocking the bobbin case 100 from the bobbin holder 200 and permitting the bobbin case 100 to be removed therefrom.

During application as described, the bobbin case tool 1 is positioned so that the locking tooth 12 is engaged in the spindle clearance 112 as best shown in FIGS. 5 and 6, thereby supporting the releasing lever 110 at the unlock position.

As the bobbin case tool 1 is lifted upwards or outward to the releasing lever's 110 unlock position as described above, the bobbin case 100 is lifted off the bobbin holder 200. Thus, the bobbin case tool 1 operates to translate the releasing lever 110 along an axis of motion, for example, in the vertical direction. After a bobbin (not shown) is replaced, an operator can then reinstall the bobbin case 100 by reversing the above-described removal procedure.

With the releasing lever 110 of the bobbin case 100 pivoted upward to its unlock position, the bobbin case 100 can readily be removed from the sewing machine. After the bobbin case 100 is mounted on the bobbin holder 200, the releasing lever 110 is released; and as the releasing lever 110 returns to its lock position, it moves the locking plate 113 into the spindle locking groove 201, thereby prohibiting the bobbin case 100 from being moved upward or outward from the bobbin holder 200. The sewing machine is then ready to resume its sewing operation.

While a clear structural plastic is a preferred material of construction for the bobbin tool 1, as obvious to one skilled in the art, there are a number of resilient materials, including metals that can serve the same purpose.

Although the description above contains many specificities, these should not be construed as limiting the scope of the invention but as merely providing illustrations of some of the presently preferred embodiments of this invention.

It will be obvious to one skilled in the art that modifications may be made to the embodiments described above without departing from the scope of the present invention. Thus the scope of the invention should be determined by the appended claims in the formal application and their legal equivalents, rather than by the examples given.

I claim:

1. A bobbin case tool for use with a sewing machine, the sewing machine which includes a bobbin case, said bobbin case tool comprising:

an elongated arm, a grip means comprising a locking tooth, a clearance, and a pair of lead in chamfers, and wherein said grip means is disposed at a distal end of said elongated arm, which grip means releasably engages a releasing lever of the bobbin case in order to load or eject said bobbin case.

2. The bobbin case tool as recited in claim 1, wherein said locking tooth releasably engages a spindle clearance of the releasing lever which supports said releasing lever in an unlock position.

3. The bobbin case tool as recited in claim 1, wherein said locking tooth is sandwiched between the pair of lead in chamfers.

4. The bobbin case tool as recited in claim 3, wherein a locking tooth face is disposed at a distal end of said locking tooth.

5. A method of unlocking a bobbin case from a prior art sewing machine with a bobbin case tool including the steps of:

engaging a forward edge of a bobbin case's releasing lever with one of a pair of lead in chamfers of the bobbin case tool, urging the releasing lever in an unlocking direction such that a locking tooth of said bobbin case tool is engaged in the releasing lever's spindle clearance, urging the releasing lever in said direction until the bobbin case's locking plate is forced out of a spindle locking groove, and lifting the bobbin case tool so that the bobbin case is lifted off the sewing machine's bobbin holder.

6. The method as recited in claim 5, wherein the locking tooth of the bobbin case tool is sandwiched between said pair of lead in chamfers.

7. A bobbin case tool comprising an elongated arm having a locking tooth disposed at an end of the bobbin case tool, said locking tooth releasably engages a spindle clearance of a releasing arm of a sewing machine's bobbin case in order to load or eject said bobbin case, and wherein the bobbin case tool further comprising a clearance, a pair of lead in chamfers, and a locking tooth face disposed at a distal end of said locking tooth, wherein said locking tooth is sandwiched between said pair of lead in chamfers.

* * * * *